US006959917B2

(12) United States Patent
Hernandez et al.

(10) Patent No.: US 6,959,917 B2
(45) Date of Patent: Nov. 1, 2005

(54) UTILITY BAR WITH BOWED SHANK

(75) Inventors: Hector Hernandez, Fullerton, CA (US); Jaime Nash, Rancho Santa Margarita, CA (US)

(73) Assignee: Alltrade Tools LLC, Long Beach, CA (US)

( * ) Notice: Subject to any disclaimer, the term of this patent is extended or adjusted under 35 U.S.C. 154(b) by 0 days.

(21) Appl. No.: 10/615,097

(22) Filed: Jul. 8, 2003

(65) Prior Publication Data

US 2004/0026674 A1 Feb. 12, 2004

Related U.S. Application Data

(63) Continuation of application No. 10/216,140, filed on Aug. 9, 2002, now Pat. No. 6,598,857.

(51) Int. Cl.[7] ..... B66F 15/00

(52) U.S. Cl. ..... 254/25; 254/21

(58) Field of Search ..... 254/25, 21, 30, 254/27, 23, 24, 19, 18

(56) References Cited

U.S. PATENT DOCUMENTS

| | | | | |
|---|---|---|---|---|
| 546,521 | A | 9/1895 | Gatti | |
| 569,552 | A | 10/1896 | Dunaway et al. | |
| 941,476 | A | 11/1909 | Wakely | |
| 949,337 | A | 2/1910 | Trogner | |
| 1,486,820 | A | 1/1922 | Wllder | |
| 1,508,489 | A | 7/1922 | Vlchek | |
| 2,272,362 | A | 5/1941 | Barker | |
| 2,896,910 | A | 7/1959 | Cooper et al. | |
| 3,134,574 | A | 1/1962 | Reuterfors | |
| 3,522,932 | A | 2/1968 | Nakasone | |
| 3,680,834 | A | 8/1972 | Holloway | |
| 4,844,416 | A * | 7/1989 | Hand | 254/25 |
| 5,577,711 | A | 11/1996 | Shine | |
| 5,695,171 | A | 12/1997 | Shine | |
| 5,695,172 | A * | 12/1997 | Hreha | 254/25 |
| 5,957,429 | A * | 9/1999 | Khachatoorian | 254/25 |
| 6,257,553 | B1 * | 7/2001 | Khachatoorian | 254/25 |
| 6,598,857 | B1 * | 7/2003 | Hernandez et al. | 254/25 |

* cited by examiner

*Primary Examiner*—Lee D Wilson
(74) *Attorney, Agent, or Firm*—John J. Connors; Connors & Assoc. Inc.

(57) ABSTRACT

A utility bar is disclosed comprising a bowed shank, a lever piece and a junction that couples the shank to the lever piece. A chisel may also be coupled to the bowed shank.

8 Claims, 6 Drawing Sheets

18a
18e
18c
18
18f
18d
18b
12c
10
20
12
16
14a
14
14d
15d
14b
15a
14f
14c
15c
15
14e
4
4
18a
18
18b
12b
12
12c
3
3
24
20
22 d2
26
d1
20
24
12c
22

16a
12a
16g
16c
16e
16
16b
14c
14e
14b
16f
14a
14f

UTILITY BAR WITH BOWED SHANK

RELATED PATENT APPLICATIONS & INCORPORATION BY REFERENCE

This application is a continuation application of U.S. Ser. No. 10/216,140, entitled "Utility Bar With Bowed Shank," filed Aug. 9, 2002, now U.S. Pat. No. 6,598,857. This related application is incorporated herein by reference and made a part of this application. Moreover, the inventors incorporate herein by reference any and all U.S. patents, U.S. patent applications, and other documents cited or referred to in this related application or cited or referred to in the U.S. patents and U.S. patent applications incorporated herein by reference.

BACKGROUND OF INVENTION

Numerous utility bars or prying tools have been known, these exhibiting different configurations and sizes. Most of the bars operate as a lever. A first class lever is one wherein the load to be overcome is at or near one end of a rod, and a force is applied at or near the other end of the rod, and a pivot point (fulcrum) is somewhere along the rod in between the applied force and load. Thus, the user seeks to obtain a mechanical advantage by placing one end of the rod adjacent to the object to be moved, and providing a pivot point about which a longer moment arm is provided so that substantial forces can be applied to the object to be pried open or moved. Examples of utility bars are disclosed in U.S. Pat. No. 5,957,429 and U.S. Pat. No. 6,257,553.

SUMMARY OF INVENTION

This invention, with its several desirable features, is summarized in the CLAIMS that follow. After reading the following section entitled "DETAILED DESCRIPTION," one will understand how the features of this invention provide its benefits, which include, but are not limited to providing a utility bar with a bowed shank that offers an improved mechanical advantage and affords the user a free end spaced from a surface of an object being levered.

The utility bar of this invention comprises a lever piece and a bowed shank integrally formed from a single piece of metal. The lever piece and a bowed shank form a substantially L-shaped prying hook, The bowed shank has a curved, longitudinally extending center line, with a first end and a second end between which the curved centerline extends. The lever piece and centerline of the shank form an angle of 90° or less.

The lever piece faces inward from the first end, and has a substantially flat and straight exterior surface. The lever piece and a bowed shank are joined together by a junction having a curved outer surface that merges with the exterior surface of the lever piece. The junction is substantially V-shaped with two legs of the junction forming an angle of 90° or greater. An interfaces between the junction and the lever piece define a start position of a traveling pivot point lying inward of the centerline. The greater the distance this start position is from the centerline, the greater the mechanical advantage provided. The bar may also include a chisel piece at the second end of the bowed shank. The chisel piece may face either outward or inwards.

DESCRIPTION OF DRAWINGS

Some preferred embodiments of this invention, illustrating all its features, will now be discussed in detail. These embodiments depict the novel and non-obvious utility bar of this invention as shown in the accompanying drawings, which are for illustrative purposes only. These drawings includes the following figures (FIGS.), with like numerals indicating like parts.

DETAILED DESCRIPTION

Some Preferred Embodiments

Figures 2, 3, 4:
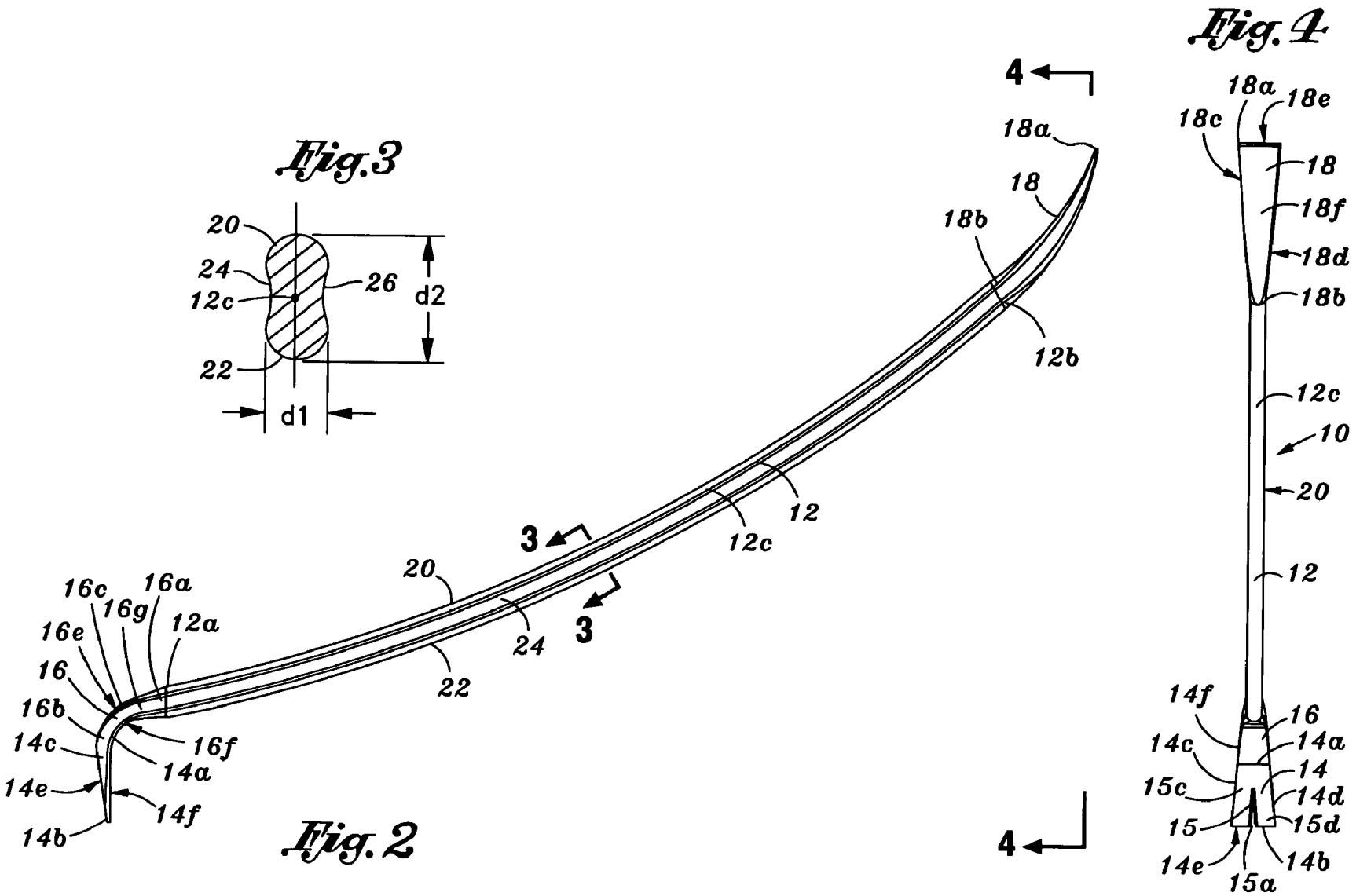
FIG. 2 is a side view of the bar.
FIG. 3 is a cross-sectional view of the bar taken along line 3—3 of FIG. 2.
FIG. 4 is view of the bar taken along ling 4—4 of FIG. 2.
Figure 5:
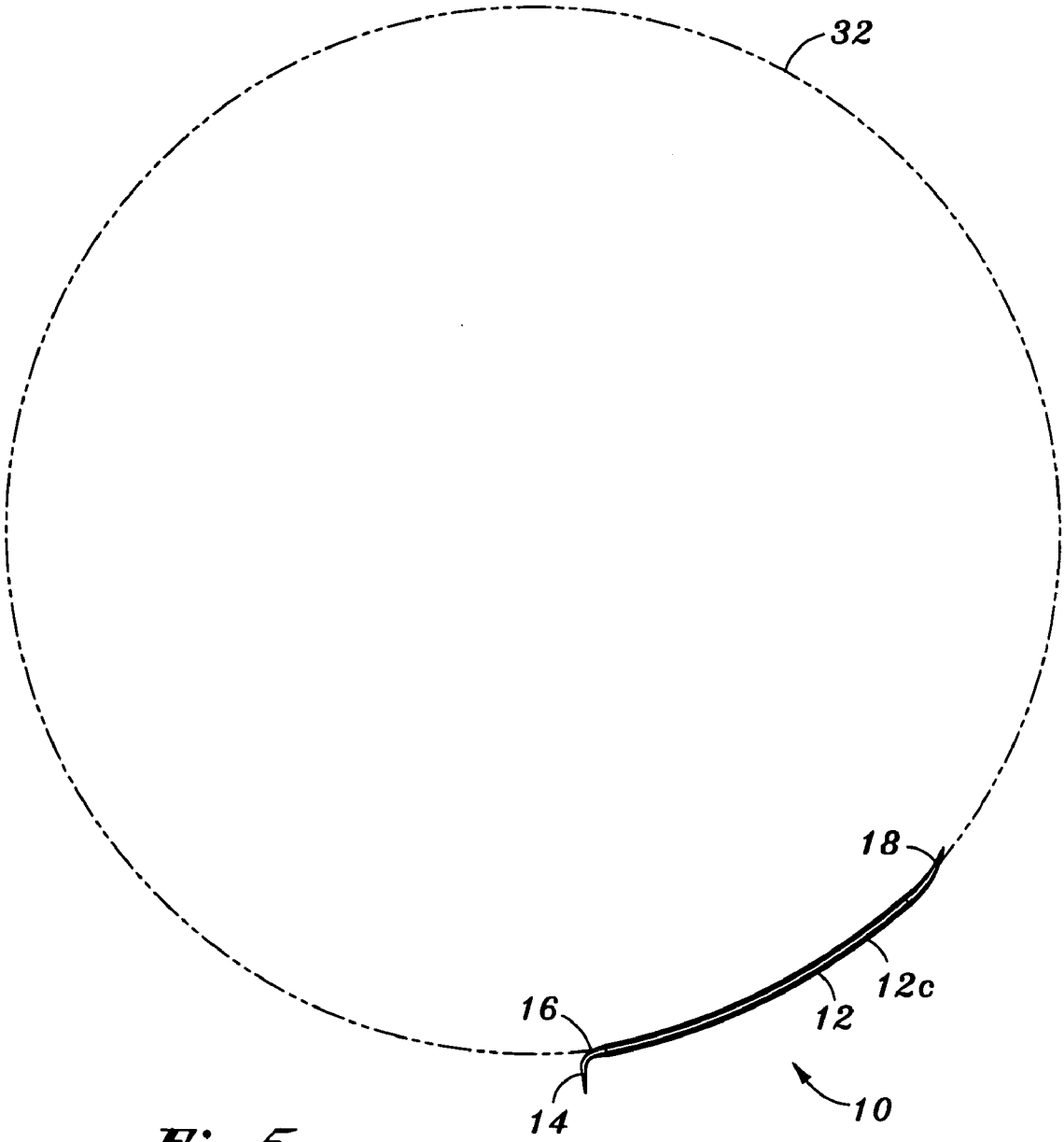
FIG. 5 illustrates a circular curvature of the centerline of the shank.
Figure 6:
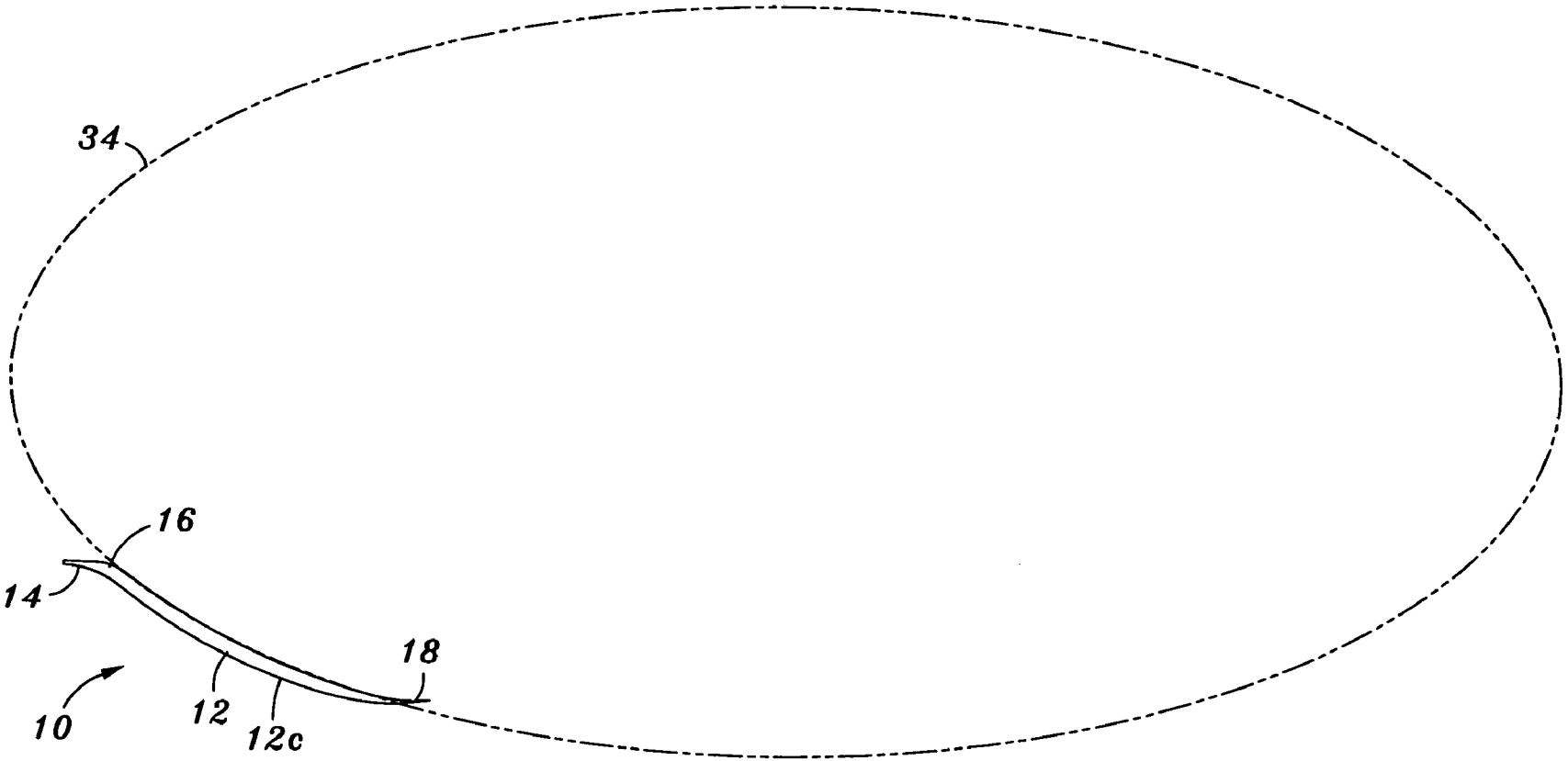
FIG. 6 illustrates an elliptical curvature of the centerline of the shank.

Referring to FIGS. 1, 2, 3, 4 and 8, the utility bar 10 generally comprises a bowed shank 12, a lever piece 14 and a junction 16 that couples the shank 12 and the lever 14. The shank 12 has a first end 12*a* and a second end 12*b* and a curved centerline 12*c* extending longitudinally between the first end 12*a* and second end 12*b*. Referring to FIG. 3, the cross-section of the shank 12 has substantially an hourglass configuration. The hourglass configuration has an outer rounded surface 20, an inner rounded surface 22, and curved surfaces 24 and 26 connecting the rounded surfaces 20, 22. The cross-section of the shank 12 may have other shapes, such as, hexagonal, elliptical, and circular. As illustrated in FIG. 5, the centerline 12*c* of the shank 12 may take the shape of a portion of a circle 32, or as illustrated in FIG. 6, may take the shape of a portion of an ellipse 34.

Figure 1:
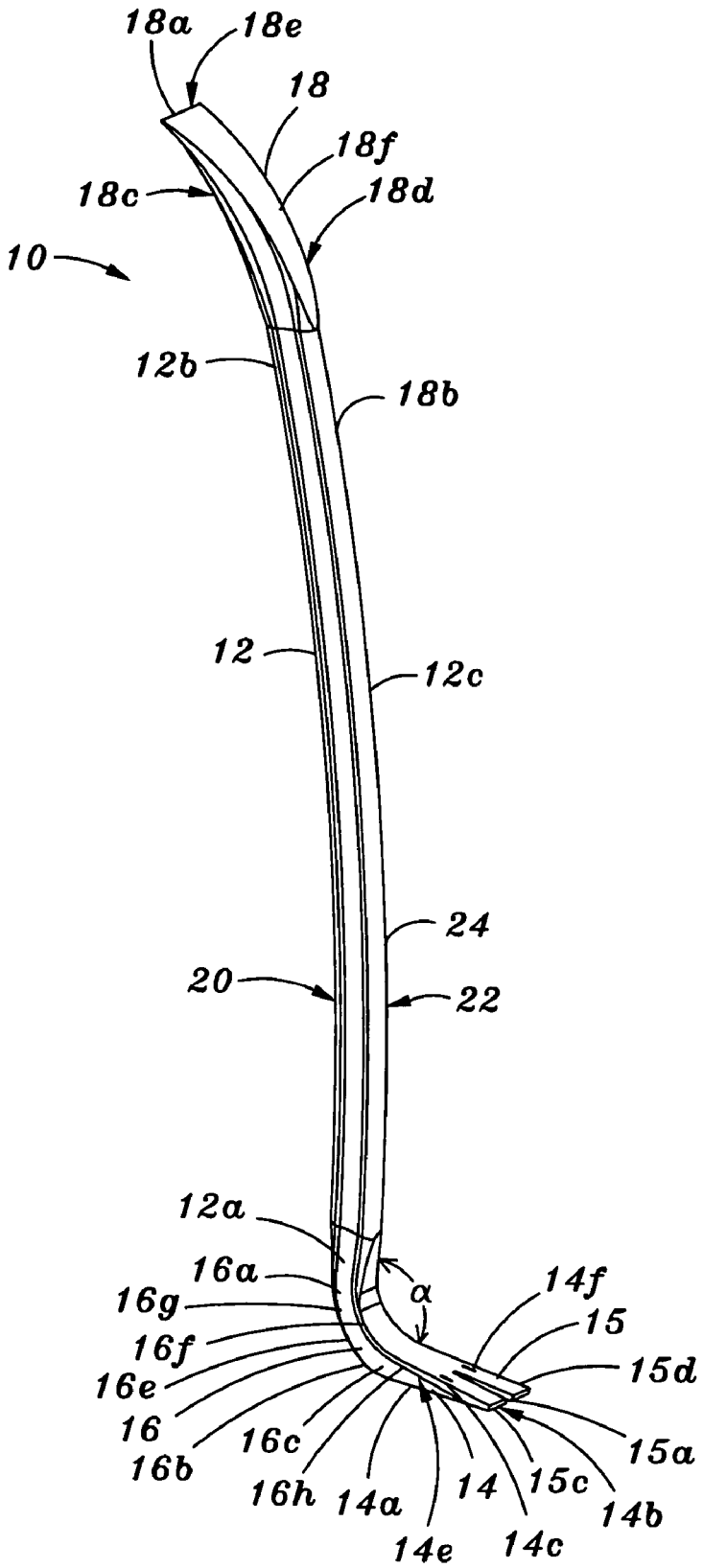
FIG. 1 is a perspective view of the bar of this invention.

Referring to FIGS. 1, 2 and 4, the lever piece 14 is substantially a wedge in shape with a flat, straight, outer exterior surface 14*e*, a flat, straight, inner surface 14*f*, a junction end 14*a*, a bladed end 14*b* and sides 14*c* and 14*d*. The angle A between outer surface 14*e* of the lever piece 14 and the centerline 12*c* of the shank is typically ninety (90) degrees or less. In one aspect of the invention, sides 14*c*, 14*d* of the lever piece 14 are tapered, preferably wider at the bladed end 14*b* than at the junction end 14*a*. In one embodiment, the lever piece 14 has a notch 15, with the open end 15*a* of the notch at the bladed end 14*b* of the lever piece 14 that divides the lever piece 14 into two blade segments 15*c* and 15*d*. Referring to FIG. 8, the thickness $t_2$ of the bladed end 14*b* of the lever piece is less than the thickness $t_1$ at the junction end 14*a* to facilitate the insertion of the bar 10 underneath an object 40 (FIG. 7) to be lifted.

As best shown in FIGS. 1, 2 and 8, the junction 16 is a curved member having outer curved surface 16*e*, an inner curved surface 16*f*, a shank end 16*a*, a lever end 16*b*, a pair of sides 16*c* and 16*d* and a pair of legs 16*g*, 16*h*. The shank end 16*a* of the junction 16 is integrally coupled to the first end 12*a* of the shank 12 and the lever end 16*b* of the junction 16 is integrally coupled to the junction end 14*a* of the lever 14. The legs 16*g* and 16*h* of junction 16 form a substantially V-shape, and these legs 16*g* and 16*h* form an angle $\alpha$of ninety degrees or greater.

The bar 10 may also comprise a curved, tapered chisel piece 18. The chisel piece 18 generally has the shape of a wedge with an inner end 18*b*, an outer end 18*a*, an inner surface 18*f*, an outer surface 18*e*, and sides 18*c* and 18*d*. The inner end 18*b* of the chisel piece is coupled to the second end 12*b* of the shank 12. The chisel piece 18 is tapered such that the inner end 18*b* is thicker than the outer end 18*a*. The chisel piece 18 typically curves in an outward direction. The chisel piece 18 may also curve inwardly.

Figure 7:
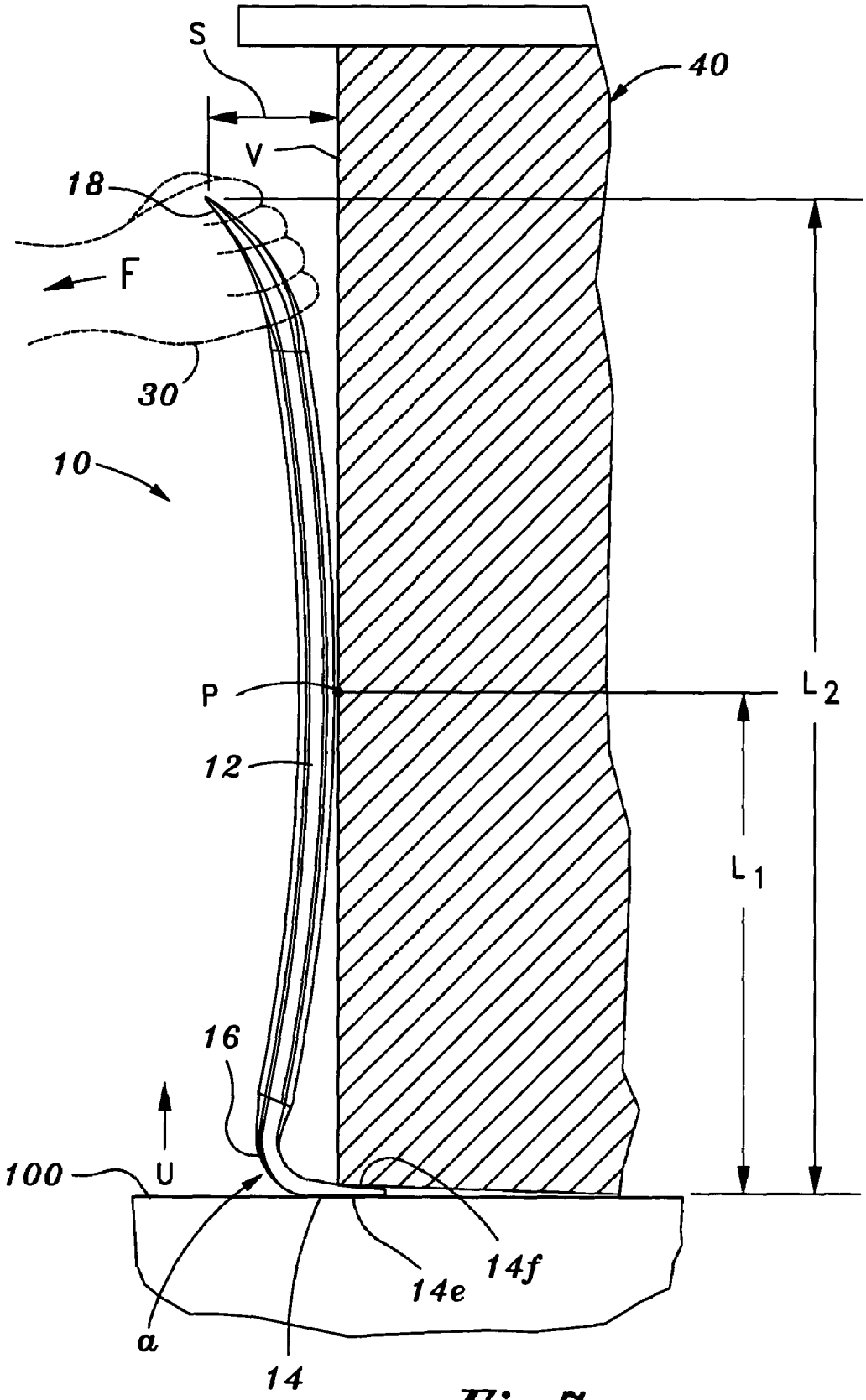
FIG. 7 illustrates the bar inserted underneath an object.
Figure 8:
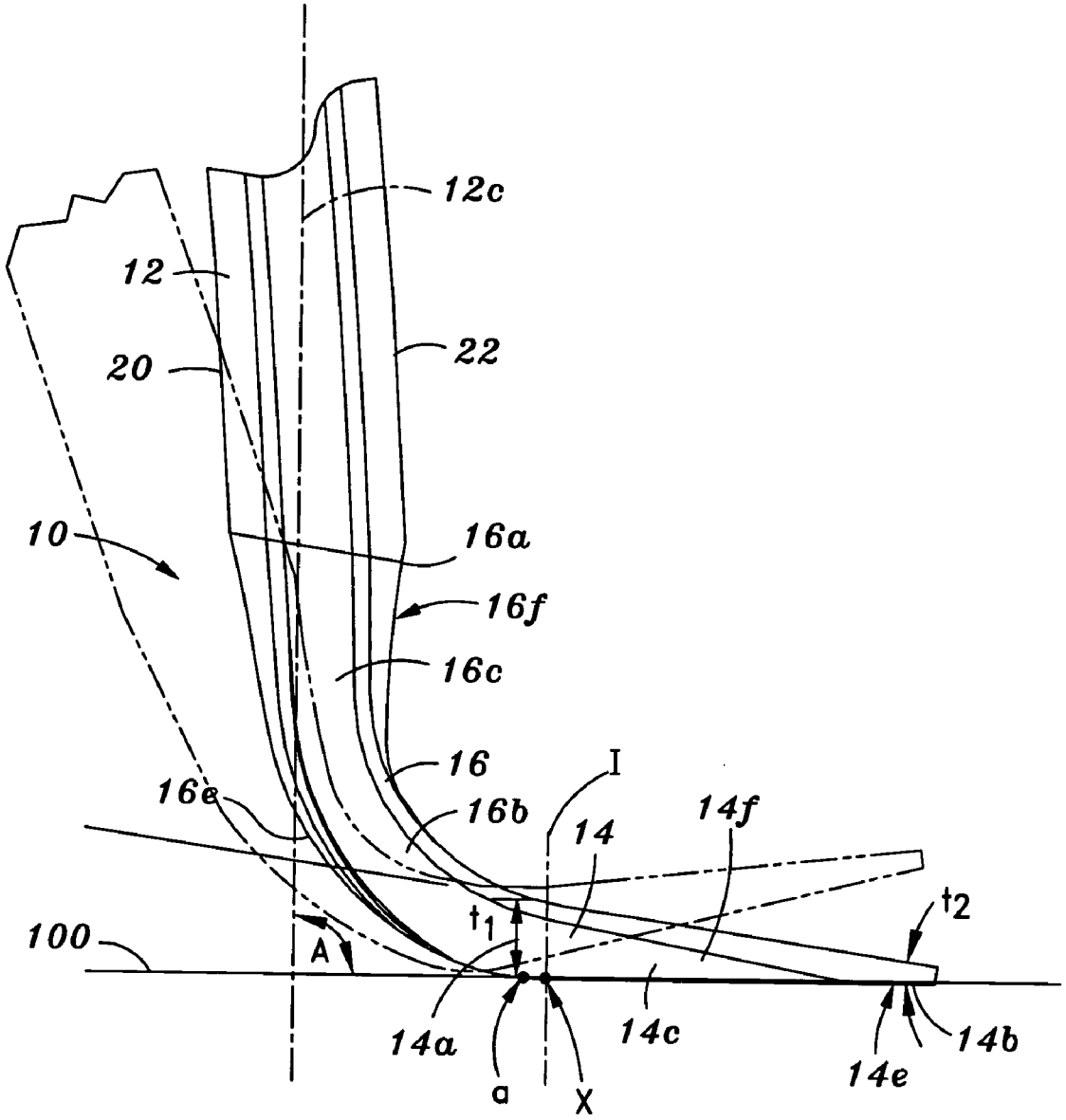
FIG. 8 is an enlarged fragmentary view of the bar taken along line 8 of FIG. 7.

Referring to FIGS. 7 and 8, the bar 10 is used by inserting the lever piece 14 underneath and the object 40 to be lifted such that the outer surface 14*e* of the lever piece faces a supporting surface 100 and the inner surface 14*f* faces the object 40. An intermediate portion P of the shank 12 typically contacts a vertical surface V of the object 40 at a distance $\mathbf{1}_1$ from the supporting surface 40. A user 30 lifts the object 40 by applying a force F to the chisel piece 18 attached to the shank 12. In this example, the force F is directed away from the object and is substantially perpendicular to the centerline of the shank. The shank 12 acts as one moment arm and the lever piece 14 acts as the other moment arm. The bar 10 rotates when the force F is applied, causing the object 40 to rise in direction u. The bar 10 initially rotates about a starting pivot point x located on the outer surface 16*e* at the intersection with the interface I. The operative moment arm of the bar 10 is the distance $\mathbf{1}_2$ between the force F and pivot point x.

Referring to FIG. 8, when force F is first applied, the pivot point is at x, which lies inward of the centerline 12*c* of the shank 12 and usually is at an interface I where the lever end 16*b* of the junction 16 and the terminus T of flat end 14*a* of the lever 14 meet. As shown in dotted lines in FIG. 8, with the counterclockwise rotation of the bar 10, the pivot point x moves along the outer surface 16*e* of the junction 16 towards the shank 12 to a point a.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A utility bar having a substantially L-shaped configuration formed by a lever piece having a substantially flat and straight exterior surface and a bowed shank having a longitudinal curved center line, said lever piece and bowed shank joined by a junction member including a curved outer surface extending between the lever piece and shank, said curved outer surface of the junction member merging with the flat and straight exterior surface of the lever piece to form an interface that defines a start position of a traveling pivot point that is inward of the center line, said flat and straight exterior surface of the lever piece being at an angle of 90° or less with respect to the center line.

2. The utility bar according to claim 1 where said centerline is configured in the shape of a portion of the circumference of a circle.

3. The utility bar according to claim 1 where said shank has a substantially hourglass cross-sectional configuration.

4. A utility bar comprising a lever piece and a bowed shank integrally formed from a single piece of metal and defining a substantially L-shaped prying hook, said bowed shank having a curved, longitudinally extending center line and a substantially hourglass cross-sectional configuration, said lever piece being at an angle of 90° or less with respect to the center line.

5. The utility bar according to claim 4 where the center line is substantially configured in the shape of a portion of the circumference of a circle.

6. The utility bar according to claim 4 where the lever piece and bowed shank are joined together by junction member including a curved outer surface merging with a flat and straight exterior surface of the lever piece to form an interface that defines a start position of a traveling pivot point that is inward of the center line.

7. The utility bar according to claim 1 where the exterior surface of the lever piece is at an angle of 90° or less with respect to the center line.

8. A utility bar comprising a lever piece and a bowed shank integrally formed from a single piece of metal and defining a substantially L-shaped prying hook, said lever piece having a substantially flat and straight exterior surface, said bowed shank having a substantially hourglass cross-sectional configuration and a curved, longitudinally extending center line that is configured in the shape of a portion of the circumference of a circle, and said lever piece and bowed shank being joined together by junction member including a curved outer surface merging with the flat and straight exterior surface of the lever piece to form an interface that defines a start position of a traveling pivot point that is inward of the center line.

said flat and straight exterior surface of the lever piece being at an angle of 90° or less with respect to the center line.

* * * * *